United States Patent [19]

Laursen

[11] 4,140,069

[45] Feb. 20, 1979

[54] SEWING METHOD FOR THE FORMATION OF A DOUBLE BACK STITCH SEAM AND DEVICE FOR CARRYING OUT THE METHOD

[76] Inventor: Ove Laursen, Skogshyddan, S-520, Dalum, Sweden

[21] Appl. No.: 819,155

[22] Filed: Jul. 26, 1977

[30] Foreign Application Priority Data

Jul. 26, 1976 [DE] Fed. Rep. of Germany ..... 2633525

[51] Int. Cl.[2] ..... D05B 1/08

[52] U.S. Cl. ..... 112/154; 112/262

[58] Field of Search ..... 112/154, 170, 262, 21, 112/22, 25-27

[56] References Cited

U.S. PATENT DOCUMENTS

| | | | |
|---|---|---|---|
| 2,487,988 | 11/1949 | Zeler | 112/262 X |
| 3,763,799 | 10/1973 | Böttcher | 112/21 |

*Primary Examiner*—Peter Nerbun

*Attorney, Agent, or Firm*—Darby & Darby

[57] ABSTRACT

The invention concerns a method and apparatus for forming a double back stitch seam from an upper and lower thread where the upper thread is conducted down by means of a needle through a sewing material and then up again, forming a loop at its underside and the lower thread is conducted through the upper thread loop and anchored on the sewing material by tightening the latter.

35 Claims, 16 Drawing Figures

SEWING METHOD FOR THE FORMATION OF A DOUBLE BACK STITCH SEAM AND DEVICE FOR CARRYING OUT THE METHOD

BACKGROUND OF THE INVENTION

In a double back stitch seam, the upper and lower threads are twisted at each stitch. With proper thread tension, the twisted area extends up to about the middle of the sewing material thickness, so that about the same pattern of a back stitch seam is formed on both sides of the sewing material. With a properly formed seam, each thread is so firmly anchored from stitch to stitch that the seam cannot be opened neither by tightening one end of the thread, nor by severing an individual stitch.

All known methods used for forming a double back stitch seam employ the same basic principle, where a limited lower thread supply is made available in the stitch forming area under the sewing material, and where the supply is passed completely through the upper thread loop and is replaced by a new limited supply after it has been used up. All known methods can be associated with one of two method groups. In one group the thread supply is moved with its carrier and its support through the upper thread loop at each stitch, with possible variations resulting from the paths and directions of motion during or between the stitch formations. The other, newer group of methods works with a stationary lower thread supply about which the upper thread loop, widened if necessary, is pulled by a looper element. All these known methods have the disadvantage, however, that the sewing must be interrupted when the lower thread supply must be replaced. This requires the formation of the corresponding thread supplies on suitable carrier bobbins etc. and suitable mechanisms; besides, there is a loss of time caused by the replacement, and a noticeable deviation from the seam pattern at least on the underside of the sewing material. Numerous methods and devices are known for trying to keep the above-mentioned disadvantages to a minimum. However, these disadvantages cannot be completely avoided in any of the known methods, and besides, the means used are elaborate and technically complicated and, hence, susceptible to trouble.

A sewing method is also known where, instead of a double back stitch seam, a so-called chain stitch seam or double chain stitch is formed. The simple chain stitch seam requires only an upper thread, the double chain stitch seam an upper and a lower thread. The stitches are formed by pulling each needle thread loop through the thread loop of the preceding stitch, and holding the following loop. In the simple chain stitch seam all loops are formed by the upper thread; in the double chain stitch seam the lower thread is laid by the upper thread guided in the above-described manner by means of a looper into a loop into which the needle penetrates during the next stroke and forms the upper thread loop there. Since in this method the lower thread need not be pulled completely through the upper thread loop, it is not necessary to wind a limited supply and to have it ready in the vicinity of the stitch. Chain stitch seams have the great disadvantage, however, that even if a single loop is open, that is, not anchored, the entire seam opens under a light pull. A single wrong stitch during the sewing thus yields an unusable seam. The same holds true for the slightest damage to the seam in a finished sewn product.

SUMMARY OF THE INVENTION

The object of the invention is to provide a method of the above-described type which permits, using simple means, application of the lower thread for the formation of a double back stitch seam from a thread supply of any desired size arranged at random in the vicinity of the sewing machine.

This problem is solved according to the invention in that the lower thread is formed continuously, during the sewing, in severed strands from thread material thinner than that of the upper thread. This thread material is fed from a thread supply between a feeding mechanism and a flexible tensioning device for the formation of a strand section. The strand section is passed through the upper thead loop, and its end region is anchored in the sewing material by the upper thread loop after the upper thread loop has been tightened by the tensioning device together with the previous strand section, and is used for the formation of at least the following stitch, so that the upper thread loops are held by a lower thread consisting of two or more juxtaposed or superposed strand sections.

This method yields a double back stitch seam where the stitches on the underside consist of several thread material layers, a freshly supplied strand section, and the end regions of one or several previously processed strand sections. The material thread layers are pulled by the upper thread, stitch by stitch into the sewing material and anchored there. The essential advantage of the double back stitch seam, that is good durability, is thus achieved. The thinness of the lower thread material permits regulation of the build-up of the lower threads to the desired thickness and appearance. Each thread section extends at least over two stitch lengths. It is thus anchored at least three times by an upper thread loop, so that even a wrong stitch or a damaged seam does not lead to opening of the entire seam. Since only a certain section of the lower thread, corresponding to a few stitch lengths, is guided by the upper thread, according to the invention, and not the entire lower thread supply, the latter can be of any size and arranged anywhere. It is not necessary to make a limited thread supply available. The winding and the changing of bobbins with all the disadvantages described above is thus avoided. This results in savings in working time and expenditures for additional winding mechanisms. Beyond that, the method according to the invention can be carried out with arrangements and sequences of operations which are much simpler than those used today in sewing machines, even in simple houshold sewing machines. The consumption of upper thread is greatly reduced; the upper thread loop to be formed under the sewing machine can be considerably smaller than has been the case until now since no thread supply has to be passed through. This results in shorter needle movements and shorter movements of the upper thread which, in conventional sewing methods, caused strength losses of about 60% due to the upper threads being pulled back and forth through the needle eye.

In a preferred embodiment of the method according to the invention the lower thread material is formed continuously at each stitch to a loop forming the strand section and is held with its closed end region on the tensioning device, and two thread regions leading to the closed loop end are anchored jointly on the sewing material at each tightening of the upper thread loop and at least at each following stitch. Each strand section consists thus of at least two strand subsections, a lower thread between two tightened upper thread loops with several partially overlapping lower thread material layers. The lower thread material can be selcted correspondingly thin.

Preferably each strand section has a minimum length of about three stitches. This ensures that it forms at least two full stitches, that is, that it is anchored by at least three upper thread loops, traversing the last one in sufficient length. This results in a stable seam which does not come open even when it is damaged in one stitch region.

For the formation of the stitches, the strand sections can be held by the tension device aligned as to the sewing direction and opposite to the feeding direction of the sewing material and be pulled through the upper thread loop substantially perpendicularly to the sewing direction. The strand section is brought, during its formation, into a position occupying a direction relative to the sewing material and held in this position. It also extends in a similar direction after it has been anchored on the sewing materials. It is thus only briefly moved during the passage through the upper thread loop. The strand sections are briefly released by the tension device and then engaged again.

In another embodiment of the method according to the invention, the strand sections are formed by the tensioning device in the sewing direction and in the feeding direction of the sewing material and pulled in the opposite direction, when they are passed through the upper thread loop. This has the advantage that the strand sections, when passing through the upper thread loop, are pulled into the correct position, that is, into the anchoring position, and thus made to bear tightly on the sewing material.

The end regions of the strand sections are preferably engaged and tensioned during their passage through the upper thread loop by a flexible fetching device acting in opposite direction to the tensioning device. The strand sections are thus guided during the entire stitch formation.

The end regions of all strand sections are preferably gripped and held by the tensioning and or fetching device by suction. This applies both to the strand sections that have to first be made, and those that have already been formed. This has essential advantages: By suction it is possible to grip safely any number of strand sections, even those of different length, and to tension them uniformly with less energy than would be required with mechanical devices. Furthermore, this type of gripping and holding is very gentle for the strand sections. There is no mechanical frictional stress. The thin form of the lower thread material provided for the multi-layer lower thread is particularly favorable in view of the required suction power. Furthermore a suction effect can be exactly proportioned both in its direction, so that it produces, on the one hand, sufficient attraction and tension before and during the stitch formation, on the other hand it facilitates the passage of the thread sections through the upper thread loop. A favorable side effect is that thread abrasions and other impurities are constantly sucked off below the stitch-forming area by the suction effect. This means considerable savings in working time, compared to the presently known sewing machines where the complicated and sensitive mechanism below the stitch-forming area must be frequently cleaned and must be opened and disassembled partly for this purpose.

The end regions of all strand sections are preferably fetched from the tensioning device by movement of the fetching device at least partly traversing the upper thread loop. The fetching device thus also takes over the pulling through the upper thread loop, so that no elements acting mechanically on the thread are required for the passage of the thread through the loop.

In another embodiment of the method, the lower thread material is cut off at each stitch in the vicinity of the feeding mechanism after the tightening of the upper thread loop, and a new head is gripped by the tensioning device. The seam on the underside of the sewing material is thus formed from individual lower thread material pieces which are displaced relative to each other in longitudinal direction with their heads or ends separated by about one stitch length, and each of them is anchored on the sewing material at least at three points by the upper thread loops. This results in an economical thread consumption. The free end of the freshly supplied thread material and the free front ends, in the thread feeding direction, of the thread material pieces already anchored on the sewing material, can be readily released by a fetching element after they have been pulled completely through the upper thread loop. In a simple manner, for example by selecting a suitable place for a severing device, the rear end of the cutoff thread material piece, in thread feeding direction, can be pulled into the sewing material during the formation of the stitch.

The invention also provides a device for carrying out the method with a needle conducting the upper thread through the sewing material, including a mechanism for movement of the needle as well as for the formation of the upper thread loop under the sewing material and for its tightening, a step feed for the sewing material, a device under the thread loop for moving the lower thread through the upper thread loop, a feeding mechanism withdrawing the lower thread material from a supply and conveying it, at least one flexible tensioning device gripping the thread material supplied for the formation of the strand section, and an oscillating fetching device for the lower thread which is arranged, under the sewing material, in the vicinity of the projection of the seam path so that the strand section can be gripped by the fetching device and moved through the upper thread loop. The fetching device can be designed as a mechanical looper which passes the stretched thread sections held by the tensioning device through the upper thread loop and releases them after the passage, so that they can be gripped again by the tensioning device.

In a preferred embodiment the tensioning and/or the fetching device are designed as nozzles which can be switched selectively for suction or blowing, and which move the strand sections for the formation of a stitch according to the direction of air flow.

An economical design of the device according to the invention, ensuring the necessary quick operation of the device provides for a common air feeding mechanism adjoining, selectively, the tensioning - or fetching device or both devices.

The tensioning device and the fetching device can preferably each have a housing with a passage for the strand sections arranged in such a way that the two passages adjoin each other in the end feeding position of the fetching device. The two housings form thus a substantially closed unit in which the lower thread sections and their end regions can move independent of outer influences other than the respective airflows. A reliable and satisfactory stitch formation is thus ensured.

The entire stitch forming process can be controlled in time in a simple manner by a gear coupled with the lifting mechanism of the needle for moving the fetching device, for actuating three-way valves in the air supply and for opening and closing the outlet ports of the tensioning devices.

Another embodiment of the device according to the invention for carrying out the variation of the method provides that the feeding mechanism is arranged behind the needle and under and close by the projection of the seam path, and the flexible tensioning device is in front of the needle and next to the projection of the ideal seam path, and that the fetching device next to the needle can move substantially perpendicularly to the direction of the seam path.

The arrangement of the feeding mechanism and of the tensioning device with respect to each other and to the seam path and its ideal extension ensures that the strand section formed by the lower thread is stretched close by the respective upper thread loop and can be gripped safely by the fetching device.

A favorable direction of the lower thread section is achieved in a simple manner by arranging the tensioning device and the feeding mechanism on opposite sides of the seam path. The lower thread section crosses the seam direction at an angle, the intersection being preferably provided near the upper thread loop.

The feeding of the lower thread material through the region in which the needle moves in the formation the loop and the fetching device moves during the passage of the strand section, can be effected in various ways. Thus the feeding mechanism can be movable toward and away from the tension device, and/or the tensioning device can be designed to fetch the strand section over the entire or a partial region. Furthermore, a conveyer element moving into and out of the region can be assigned to the feeding mechanism. In a preferred embodiment the flexible tensioning device is designed as a suction device. It can thus attract a lower thread piece end released by the feeding mechanism and at the same time also grip the end regions of the anchored lower thread sections and tension them by suction. The space in which the needle and the fetching device move remains thus completely free. This way elaborate mechanisms for coordinating the movements can be eliminated.

For a method with lower thread material sections severed from the supply a severing device for the lower thread material can be arranged in the vicinity of the feeding mechanism. Its control, that is, the selection of the severing time, can be effected by any of the stitch-forming elements.

The fetching device can be designed as a looper with a hook-mouth arranged a distance from its point, which extends under the mouth opening to the point. It can thus engage by itself the strand sections tensioned in the vicinity of the upper threaded loop and release them again just as easily.

The opening of the hook mouth can be directed upward, if the looper has a greater distance at the end of its return stroke from the anchoring point, which has moved in the meantime with the sewing materials, than the length of the thread sections held by it, so that they automatically pull out of it laterally.

An automatic release with a shorter looper path can be achieved in a simple manner by having the hook mouth opening directed downward. As soon as the looper starts a new working stroke, the thread sections, which are still in the hook mouth, slide automatically out at the bottom. It is also possible to assign to the looper a release mechanism, for example, a swingable tongue which drops the thread sections.

In a feeding mechanism which consists of at least two conveyer rollers rolling elastically on each other, at least one of the conveyer rollers can carry a cutting element adjacent its circumference. Since the respective conveyer roller performs one revolution at each stitch, the cutting element acts to cut the thread, one time per stitch and always at the same time in the course of the stitch formation.

In a preferred embodiment, the feeding mechanism consists of a larger conveyer roller corresponding in its circumference to the desired length of the lower thread section, and at least two pressure rollers bearing at a distance from each other on the circumference of the conveyor roller. The pressure roller last encountered by the thread is designed to cooperate with the cutting element of the conveyer roller as a severing device. The design and mode of operation of the severing device is thus very simple, since neither a separate operating mechanism nor a control mechanism is required. Furthermore, the thread for the formation of the following strand is already held on the feeding mechanism by one or more pressure rollers when the preceding strand section is severed.

Embodiments of the method according to the invention and of the respective devices will result from the following description and the drawings.

DESCRIPTION OF THE DRAWINGS AND PREFERRED EMBODIMENTS

Figure 1:
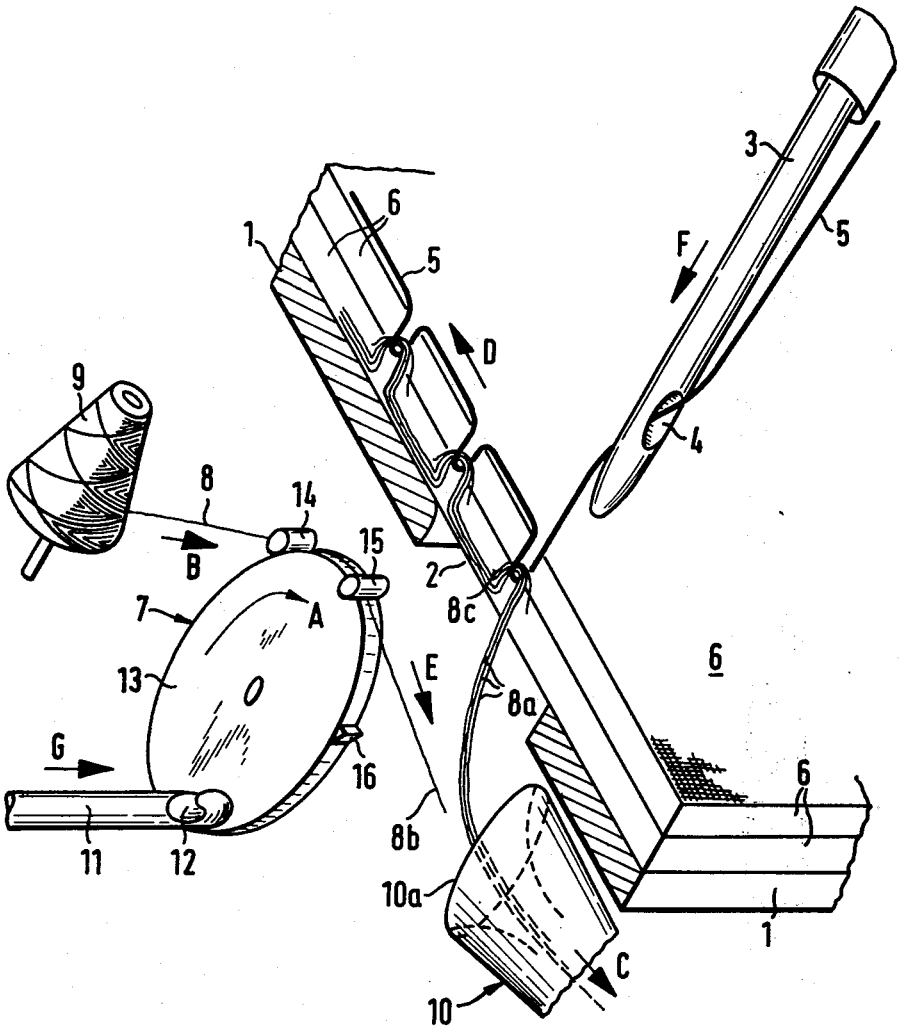
FIG. 1 shows schematically the stitch-forming area of a sewing machine with sewing material and the elements necessary for the formation of a stitch.

FIG. 1 shows schematically the stitch-forming area of a sewing machine with a device for forming a double back stitch seam. Above work support 1 a recess 2 is arranged with a needle 3 moving up and down in a known manner. Needle 3 has an eye 4 through which there is threaded an upper thread 5. On the work support there are arranged two layers of a sewing material 6.

Below work support 1 is arranged a feeding mechanism, generally designated 7, for a lower thread material 8. The lower thread material 8 is taken from a supply, indicated in FIG. 1 as a bobbin 9, which can be arranged at any desired point on or outside the sewing machine. Furthermore, a flexible tensioning device in the form of a suction nozzle 10, whose suction orifice 10*a* is directed toward the feeding mechanism, is arranged below the work support, as well as a fetching device designed as a rod-shaped looper 11 with a hook mouth 12 which can be moved back and forth in its longitudinal direction by means of an operating mechanism (not shown).

Feeding mechanism 7 consists of a conveyer roller 13 with a relatively large diameter, which is driven by a drive (not shown) in the direction of arrow A, as well as two pressure rollers 14 and 15, each with a small diameter relative to the conveyer roller. The axes of rotation of rollers 13 to 15 are parallel to each other. The lower thread material 8 passes under first pressure roller 14 whose direction of motion, indicated by arrow B, is determined by the direction of rotation A. Pressure roller 14 is made of elastic material. The thread material 8 next passes under pressure roller 15 which is made of steel and cooperates with a cutting blade 16 arranged on the circumference of conveyer roller 13 as a severing device for the lower thread material.

Feeding mechanism 7, suction nozzle 10, whose direction of suction is indicated by arrow C, and looper 11 are arranged as follows relative to the other elements: Feeding mechanism 7 is arranged directly under the seam path. The feeding direction of the sewing material during the sewing is indicated by arrow D. Needle 3 has its axis substantially perpendicular to the feeding direction D; suction nozzle 10 is arranged directly in front of the path of the needle 3 next to the seam path and on the opposite side of the sewing material 6 with respect to feeding mechanism 7 in such a way that the lower thread material 8 extends between feeding mechanism 7 and orifice 10*a* of suction nozzle 10 in a direction of conveyance E (see FIG. 2) which intersects the plane of the seam path at an angle behind the needle as seen in feeding direction D. Looper 11 can be moved back and forth in a path perpendicular to feeding direction D, which is parallel to the direction of the seam, next to the needle. The direction of motion of the looper is indicated by arrow G, in each figure corresponding to the movement just being performed or about to be performed. The same holds true for arrow F associated with the ascending and descending needle.

Figure 4:
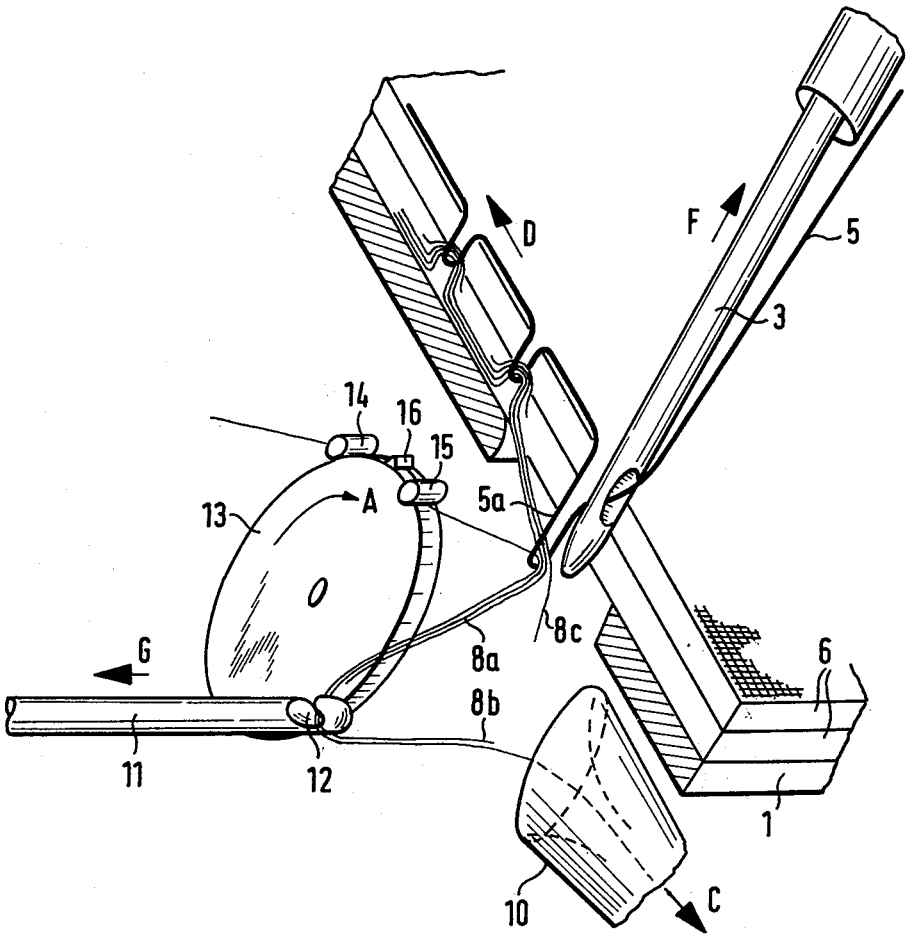
FIG. 4 shows the area after about 4/5 of the stitch-forming time.
Figure 5:
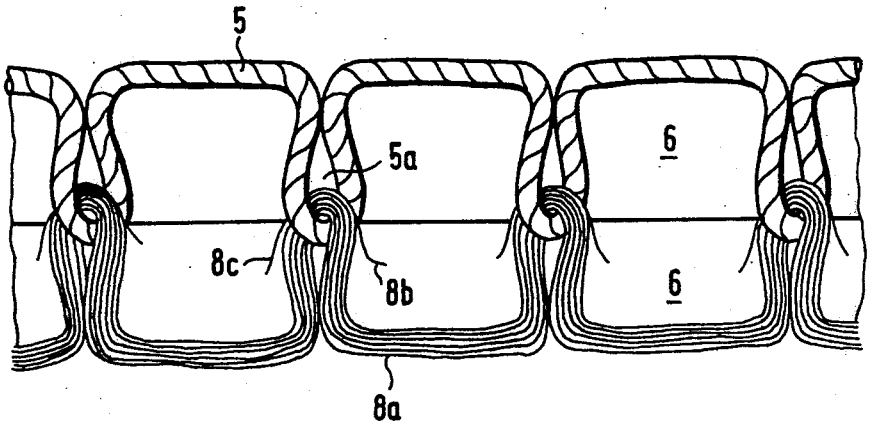
FIG. 5 shows the seam produced according to FIGS. 1 to 4 on an enlarged scale.

The double back stitch seam represented in FIG. 5 is formed by means of individual lower thread sections 8*a*, each of which has a length corresponding to the circumference of the conveyer roller 13, which in turn corresponds to the length of several stitches. The formation of a stitch is shown on the basis of FIGS. 1 to 4. FIG. 1 shows the phase directly after the formation of a stitch, that is, after upper thread 5 has been tightened which is effected in known manner by a mechanism not shown here. In the drawing, three lower thread sections 8 are anchored in the sewing material by the tightened upper thread loop. Their end regions which are of different lengths, as will be explained later, are caused by the suction effect of suction nozzle 10 to extend toward its orifice 10*a*. The conveyer mechanism has withdrawn new lower thread material 8 from the supply 9 in direction B and delivered it in direction E. The free end 8*b* is pulled through suction nozzle 10 over the free space to its orifice 10*a*. Looper 11 starts a movement in the direction of arrow G toward the stitch-forming area, and sewing material 6 is moved by one stitch length.

Figure 2:
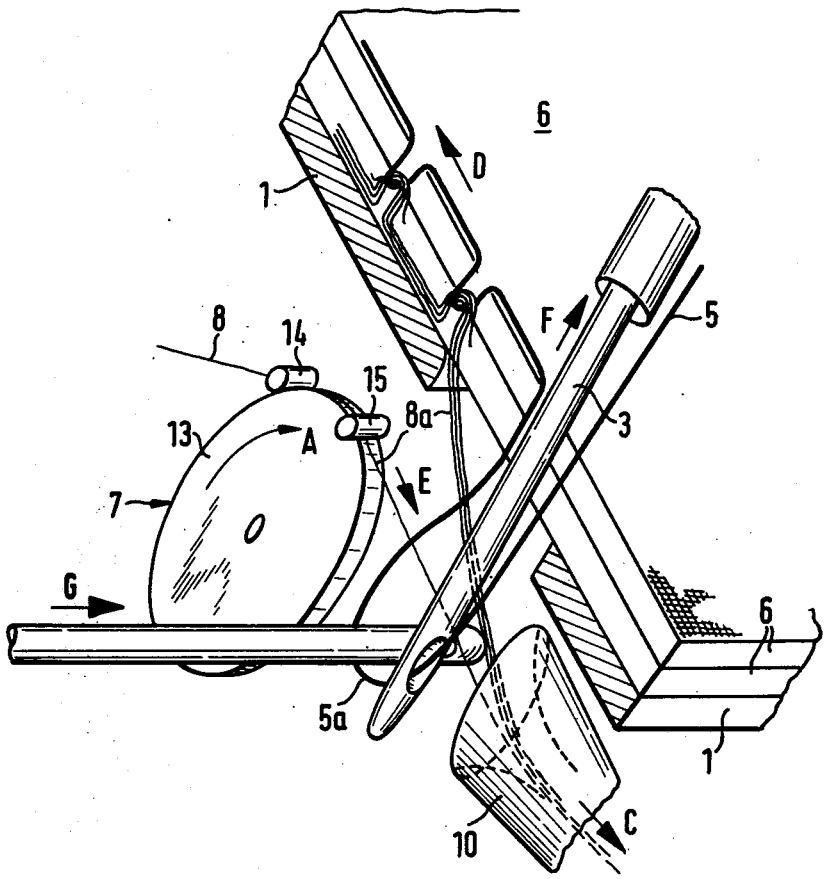
FIG. 2 shows the sewing machine area after about half the stitch forming time.

The phase of the stitch formation represented in FIG. 2 shows needle 3 at its lower point, hence before the start of its ascending movement. It has pierced through sewing material 6 and formed in cooperation with a thread feeder (not shown) under the sewing material an upper thread loop 5*a*. A new lower thread section 8*a*, which has been extended in the meantime by the rotation of conveyor roller 13, forms between feeding mechanism 7 and suction nozzle 10 a single thread stran section which extends behing upper thread loop 5*a*, just like the end regions of the previously anchored thread sections 8*a*, likewise tensioned by suction nozzle 10. Looper 11 has moved with its point through upper thread loop 5*a* and continues to move in the same direction.

Figure 3:
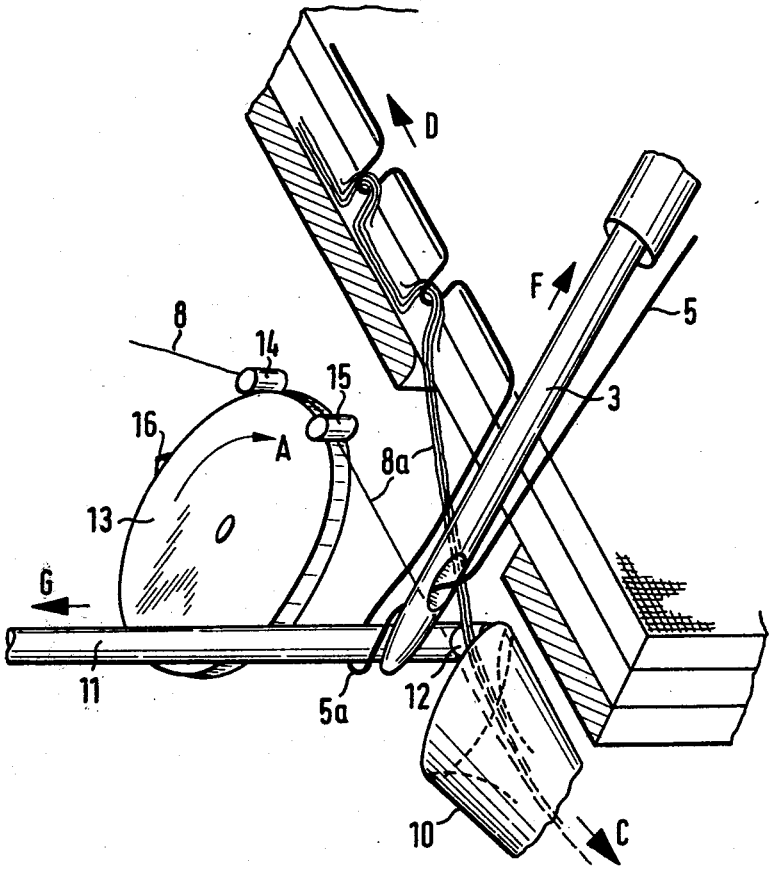
FIG. 3 shows the area after about 3/5 of the stitch-forming time.

In the phase according to FIG. 3 needle 3 is on its upward return stroke, but due to the known countermovment of the thread feeder, thread loop 5*a* is still open. Looper 11 starts now with a return stroke in the direction of arrow G and its hook mouth 12, which is open at the top, engages all thread sections 8*a* tensioned by suction nozzle 10, that is, both the end regions of the lower thread sections 8*a* already anchored on the sewing material, and the new strand section, which is still continuously connected with the thread supply 9 and is held by pressure rollers 14 and 15 on conveyer roller 13.

In its further return movement in direction G, looper 11 pulls with its hook mouth 12 the strand sections 8*a* through thread loop 5*a*, while needle 3 moves further upward. This phase is shown in FIG. 4. There is can also be seen that the knife point 15 has moved, in the meantime, under flexible conveyer roller 14 had has approached steel pressure roller 15. The upper thread loop 5*a* has in the meantime already partly been pulled upward toward the sewing material. The first stitch forming process which takes place during the phases represented in FIGS. 1 to 4 provides the following movements: The upper thread loop 5 is ultimately tightened and pulls all strand sections 8*a* traversing it into the sewing material. Knife edge 16 passes against steel roller 15, and cooperates with it to sever thread section 8*a*, so that its rear end 8*c* (FIG. 1) is pulled substantially into the sewing material. The following lower thread material, held under elastic pressure roller 14 is moved in the meantime between rollers 13 and 15 for the formation of a new strand section. Looper G at first moves further back from the stitch-forming area, so that the free lower thread material ends 8*b* pull out of its hook mouth 12 and can be gripped again by suction nozzle 10. The next stitch can start in the above described manner.

FIG. 5 shows on an enlarged scale the seam formed by joining the above described stitches. It represents a double backstitch seam which consists in contrast to the presently known double chain stitch seams, in that the lower seam region is not formed of a single lower thread but of lower thread sections 8a each of which extends over at least two stitches, that is, three anchoring zones, a new lower thread section 8a starting in each upper thread loop.

FIGS. 6 to 9 shows the same device and the same phases as in FIGS. 1 to 4, but for a method where the lower thread material is processed continuously, that is, without being severed. All parts of the device which are identical with those in FIGS. 1 to 4 have been provided with the same reference numbers, deviations are indicated by a prime sign. The same holds true for the designation of the thread sections, specifically there are the following differences:

Conveyor roller 13' carries no cutting knife, pressure roller 15' is made of the same elastic material as pressure roller 14.

The basic principle of stitch-formation is the same as in the method according to FIGS. 1 to 4, so that only the differences which result from the fact that the lower thread material is processed continuously, that is, without being severed will be discussed. The formation of the first stitch of each seam is effected in exactly the same manner as in the above described method in that feeding mechanism 7' moves the free head of the lower thread material, and the latter is tensioned by suction nozzle 10 and passed by the looper through the upper thread loop 5a and anchored by the latter on the sewing material. Looper 11' grips with its open hook mouth 12' the strand section 8a' from the bottom. In contrast to the previously described method, the lower thread section between the upper thread loop and the feeding mechanism is not interrupted, but increased, since the feeding mechanism continues to feed. The looper thus pulls a loop out of this lower thread piece, whose opening is between the sewing material, last stitch, and feeding mechanism 7, more accurately pressure roller 15'. Since the feeding mechanism continues to feed, and the loop increases and can be gripped again by the suction device, due to its own looseness after its end has been withdrawn from the hook mouth, and can be tensioned, the further movement of the sewing material in direction D resulting in a further movement of one loop end.

In the next stitch-formation, the looper engages the two strands of the last anchored loop, as well as two strands of the newly formed loop so that, after the stitch has been formed, the tightened upper thread loop 5a is traversed by the newly formed loop and the last anchored loop, while the next loop is formed between the stitch and feeding meachanism.

Figure 6:
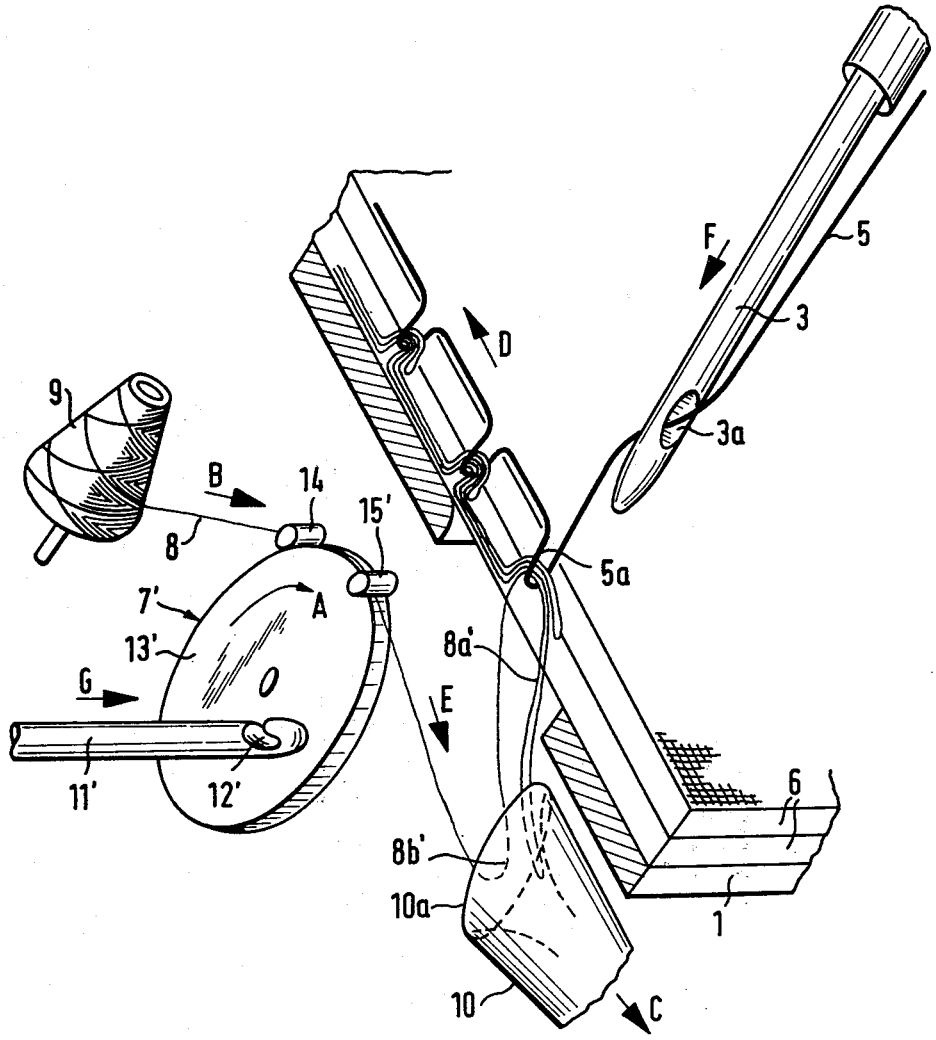
FIG. 6 shows schematically another embodiment of the stitch-forming area of a machine at a time after the completion of a stitch.
Figure 7:
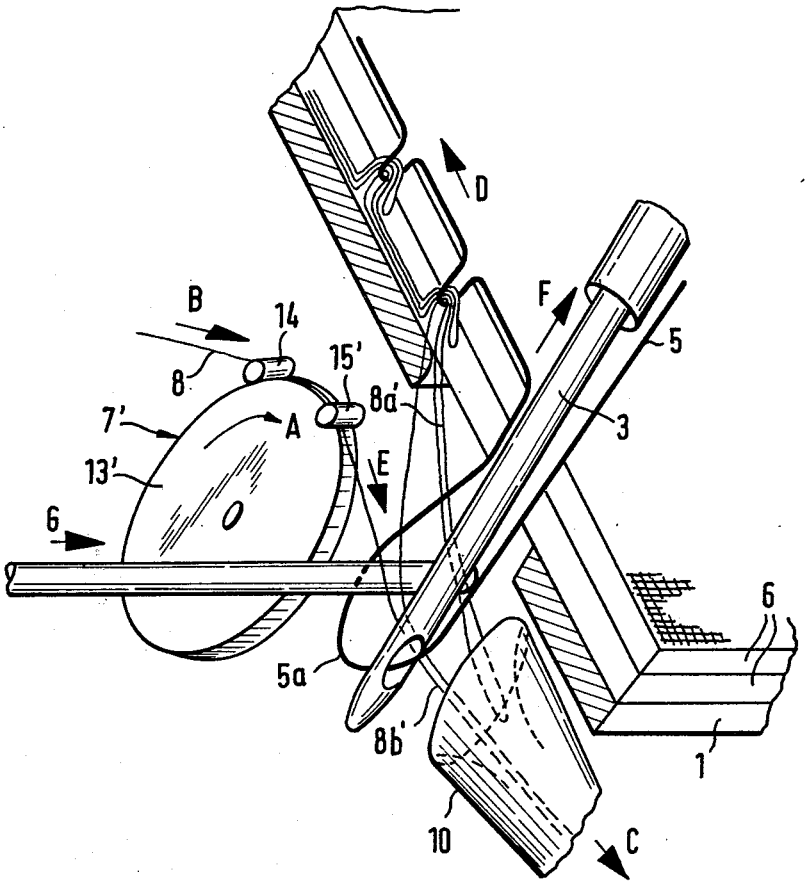
FIG. 7 shows the area according to FIG. 6 about half the stitch-forming time.
Figure 8:
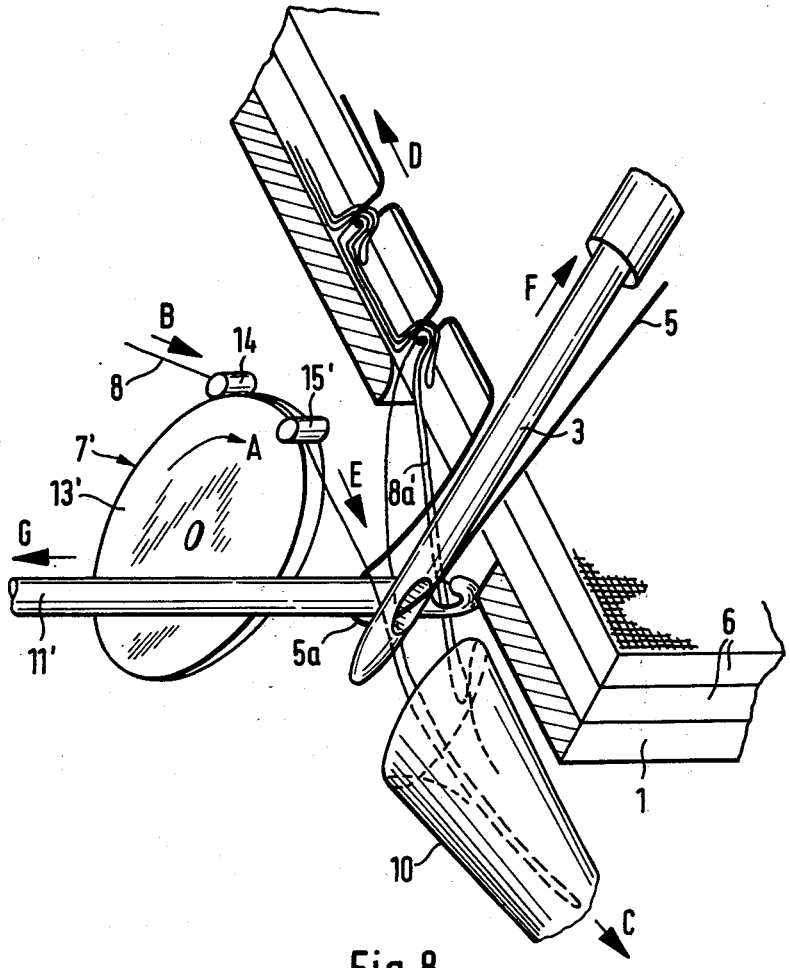
FIG. 8 shows the area according to FIG. 6, after about 3/5 of the stitch-forming time.
Figure 9:
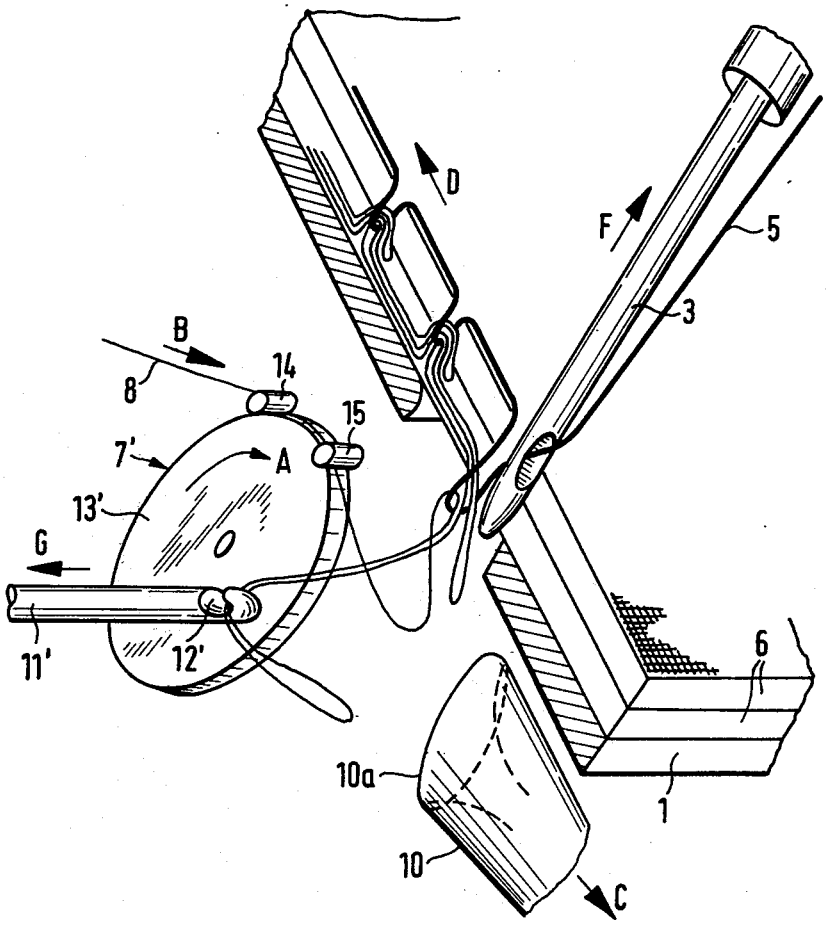
FIG. 9 shows the area according to FIG. 6 after about 4/5 of the stitch-forming time.

FIG. 6 shows the phase at the end of a stitch, where the lower thread loop 5a is traversed by the short end 8b' of the second last loop, as well as the longer loop 8a' of the last stitch, and the next loop has been formed between feeding mechanism 7 and the upper thread loop. This loop has already been released by the looper and tensioned by the suction device. In FIG. 7 the last piercing point has moved in direction D and the needle has just passed its lower dead center after it has pierced again through the sewing material. Looper 11' is already moving through upper thread loop 5a. FIG. 8 shows how looper 11' grips, at the start of its return stroke, the last anchored lower thread loop 8' and the newly formed thread loop 8a' and pulls them through the upper thread loop 5a in FIG. 9. In the phase according to FIG. 9, the looper is still in its return stroke. It thus holds the last lower thread loop 8a' still in its hook mouth, while the preceding thread loop has already pulled out of its hook mouth, due to its shortness. The last phase of the stitch-formation corresponds again to FIG. 6.

Figure 10:
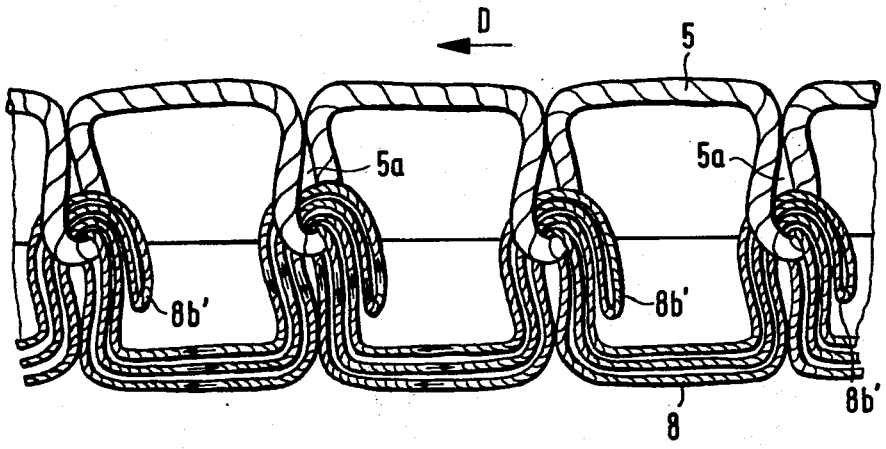
FIG. 10 shows a seam produced according to FIGS. 6 to 9 on an enlarged scale.

FIG. 10 shows on an enlarged scale the diagram of the seam pattern of a double back stitch seam. In order to facilitate the understanding of the following description it is pointed out that all lower thread sections anchored by an upper thread loop 5a lie naturally with the upper thread loop in the stitch channel of the sewing material formed by the needle. But for simplicity's sake they are represented in the drawing in loose position. Furthermore it is pointed out that for purposes of the position description used below, descriptive phases like "behind the upper thread loop" must be understood in view of the feeding direction D of the sewing material. Furthermore directional arrows are shown in the movement of the lower thread, where the sense of direction must be understood as an extension of the thread direction E between feeding mechanism 7' and suction nozzle 10.

Each upper thread loop 5a is traversed by four threads, which comprise the two top threads 8a' last anchored in this upper thread loop, whose ends 8b' are directly behind the upper thread loop. The two lower threads are the end region of a loop 8a'. which is formed in the preceding stitch formation and was anchored for the first time in this upper thread loop. The bottommost thread undergoing a reversal of direction in this thread loop is the thread which contributes in the next stitch to the formation of a new loop. Between the stitches there are three threads on the underside of the sewing material which form the visible stitch.

FIGS. 11 to 15 show a device for forming stitches with which a seam corresponding to FIG. 10 can be produced according to a variant of the method of the invention. In FIGS. 11 to 15 identical elements have been provided with the same reference numbers as in the preceding figures, deviations have been indicated by a double prime.

Figure 11:
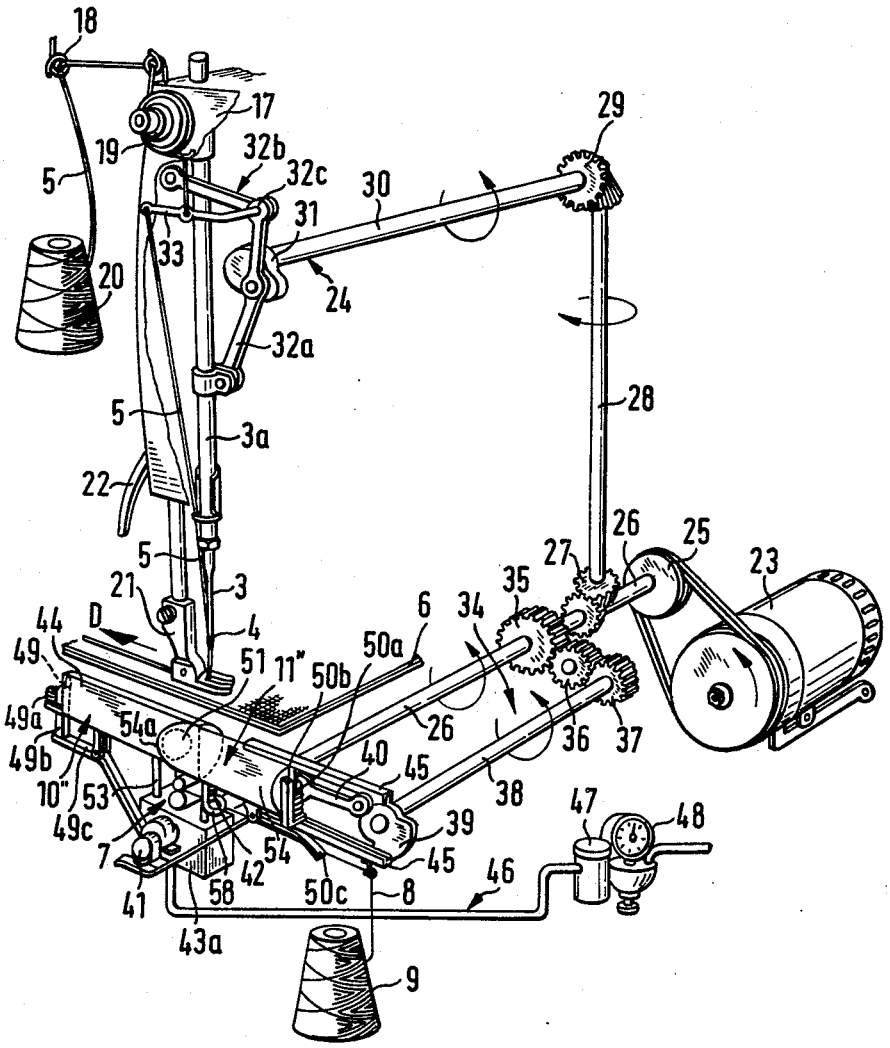
FIG. 11 shows schematically another embodiment of a device for the formation of a double back stitch seam according to another method.

FIG. 11 shows a partial area of a sewing machine with a housing 17, represented in fragment, guide elements 18, and a tension disk arrangement 19 for the upper thread 5 arriving from a delivery spool 20, with a sewing foot 21 with a hand lever 22 for lifting the latter, and with a needle bar 3a holding needle 3. Associated with needle bar 3a is an operating mechanism 24, driven by a motor 23, which has a shaft 26 driven by the motor 23 via a belt pulley 25, a 1:1 bevel gearing arrangement, a shaft 28 parallel to the needle bar driven by this gearing, another bevel gearing 29, a shaft 30 parallel to shaft 26 driven by this gearing, and at its end an eccentric disk 31. Eccentric disk 31 moves a lever system 32, of which one lever 32a acts on needle bar 3a, while the second lever 32b is a two-arm lever with a joint 32c, one end of the arms being mounted on the eccentric disk, the other on the housing, and the joint 32b being connected with a thread feeder 33.

Shaft 26 is arranged below work support 1 now shown in FIG. 11 for the sewing material 6. It is coupled with a gearing arrangement generally designated 34 for moving the lower thread 8. Gearing arrangement 34 includes a gear wheel 35 arranged on shaft 26 in a transmission ration of 1:2, an intermediate gear wheel 36 which meshes with a gear wheel 37 of the same size as intermediate gear wheel 36, and a shaft 38 arranged parallel to shaft 26 and rotating in the same direction. Shaft 38 carries at its other end a crank disk 39 connected to a connecting rod 40, whose plane of motion is vertical and parallel to the direction of the seam. Connecting rod 40 actuates a fetching device generally designated 11".

Shaft 26 moves a crank arrangement 41 and via a transmission 42, moves a feeding device 7, and a three-way valve 43 which is represented in FIG. 11 only by its housing 43*a*, which can be seen in FIGS. 12 to 15. The device in the stitch-forming area below the work support also comprises the elastic tensioning device 10' with a nozzle housing 44, guides 45 for the movement of fetching device 11" and an air feeding mechanism 46 with a valve 47 in a control mechanism 48. The nozzle housing 44 of tensioning device 10", and fetching device 11", likewise designed as a nozzle, each have at their respective ends remote from one another, outlet ports 49 and 50 respectively, as well as shutters 49*b* and 50*b* which are loaded by means of springs 49*a*, 50*a*. The shutters are moved by crank arrangement 41 via linkages 49*b*, 50*c*, against the force of the respective springs into the open position.

The nozzle housing 44 of tensioning device 10" has a substantially semi-circular cross section and is fixedly mounted under the seam. Its housing surface extends in a vertical plane and faces the outside of the machine. The plane wall surface has adjacent the end proximate the needle, a passage 51. In the interior of the housing there is provided an air channel 52 extending from the passage 51 to an outlet port 49 with a branch 52*a* extending obliquely dowward from the passage 52. Air channel 52 widens toward the outlet port and the passage has its narrowest point in the mouth region of the branch. Branch 52 is connected over a line 53 with housing 43*a* and valve 43.

Fetching device 11" has a housing 54 which is substantially identical with housing 44 of the tensionsing device, that is, it has a semi-circular cross-section, a passage 55 on the plane side, and in the interior, an air channel 56 with branch 57. The latter is connected over a flexible line 58 with three-way valve 43, the valve opening of line 58 being opposite that of line 52. Housing 54 of fetching device 11" is arranged for reciprocal movement in guides 45 by means of connecting rod 40, so that its plane surface bears during displacement partly on the plane surface of housing 54, with two passages 51 and 55 coinciding substantially so that air channels 51 and 56 form a continuous flow path. Housing 54 has at its end facing housing 44 a rounded point 54*a*.

The mode of operation of the device according to FIG. 11 will be described on the basis of FIGS. 12–15 showing the individual phases of stitch formation, the arrows for directions of motion of threads and elements being designated corresponding to the above described embodiment, substantial differences in the movements being indicated by double prime signs. FIGS. 12 to 15 incidentally show a feed 59 for the sewing material under the recess 2 of the work support 1 which is not shown in the other figures.

Figure 12:
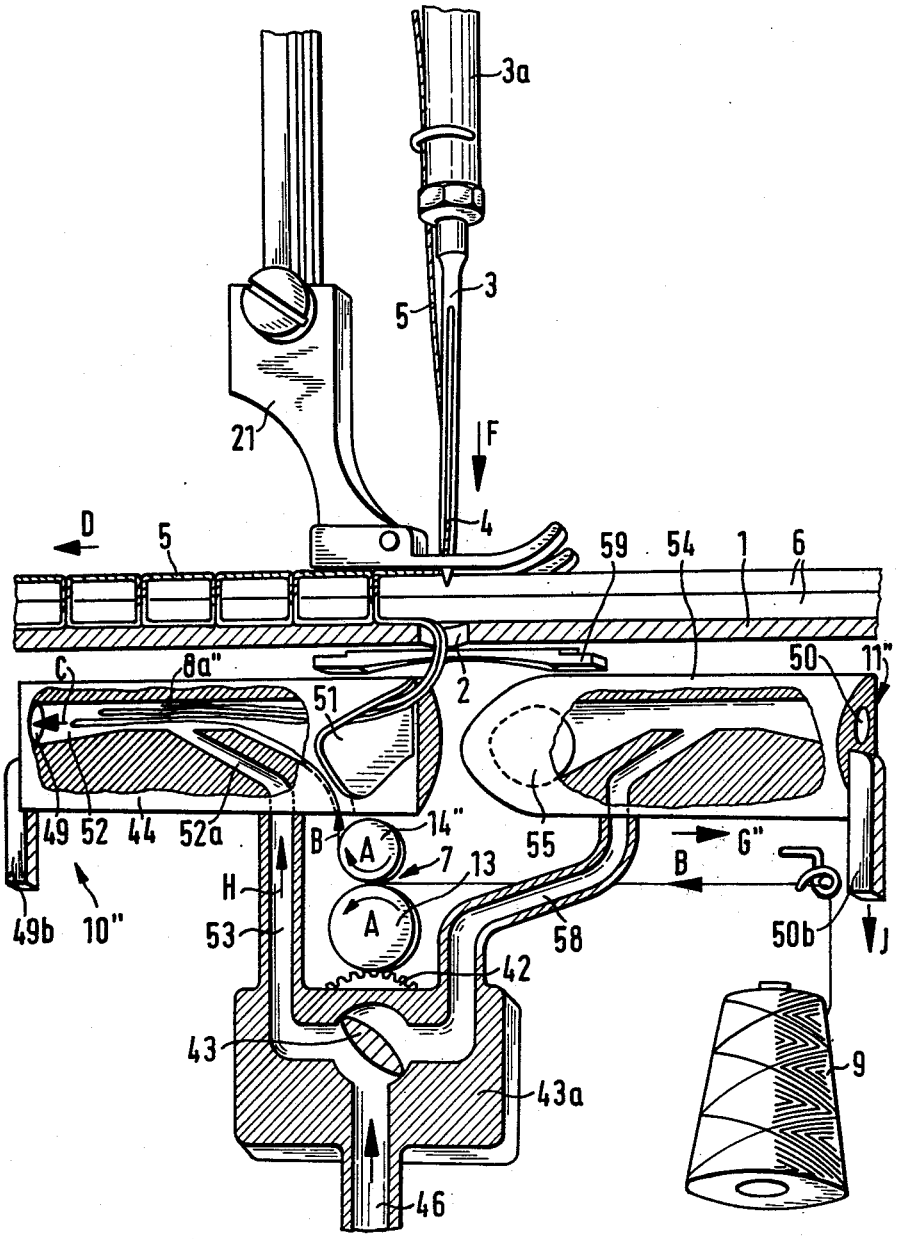
FIG. 12 shows the stitch-forming area according to FIG. 11 on an enlarged scale at the beginning of a new stitch.

FIG. 12 shows the start of the stich formation. Needle 3 moves down in the direction of arrow F through the sewing material and recess 2. Three-way valve 43 is in a first position where it connects air feeding mechanism 46 over line 53 with branch 52*a* in housing 44 of the tensioning device, so that compressed air flows in the direction of arrow H. Shutter 49*b* is in its bottom position, the open position; outlet port 49 is free. An air flow extending in the direction of arrow C is thus produced in air channel 52 which sucks in both lower strand sections in loop form 8*a*' already anchored on the sewing material, and the lower thread supplied from feeding mechanism 7 in the direction of arrow B for the formation of a new loop. The loops 8*a*' already anchored on the sewing material traverse passage 51 from the outside to the inside. The position of the three-way valve prevents the supply of air to the flexible line 58 and thus to fetching device 11", which has moved away from tensioning device 10" in the direction of arrow G", while at the same time its shutter 50*b* has moved down in the direction of arrow I, exposing outlet port 50.

Figure 13:
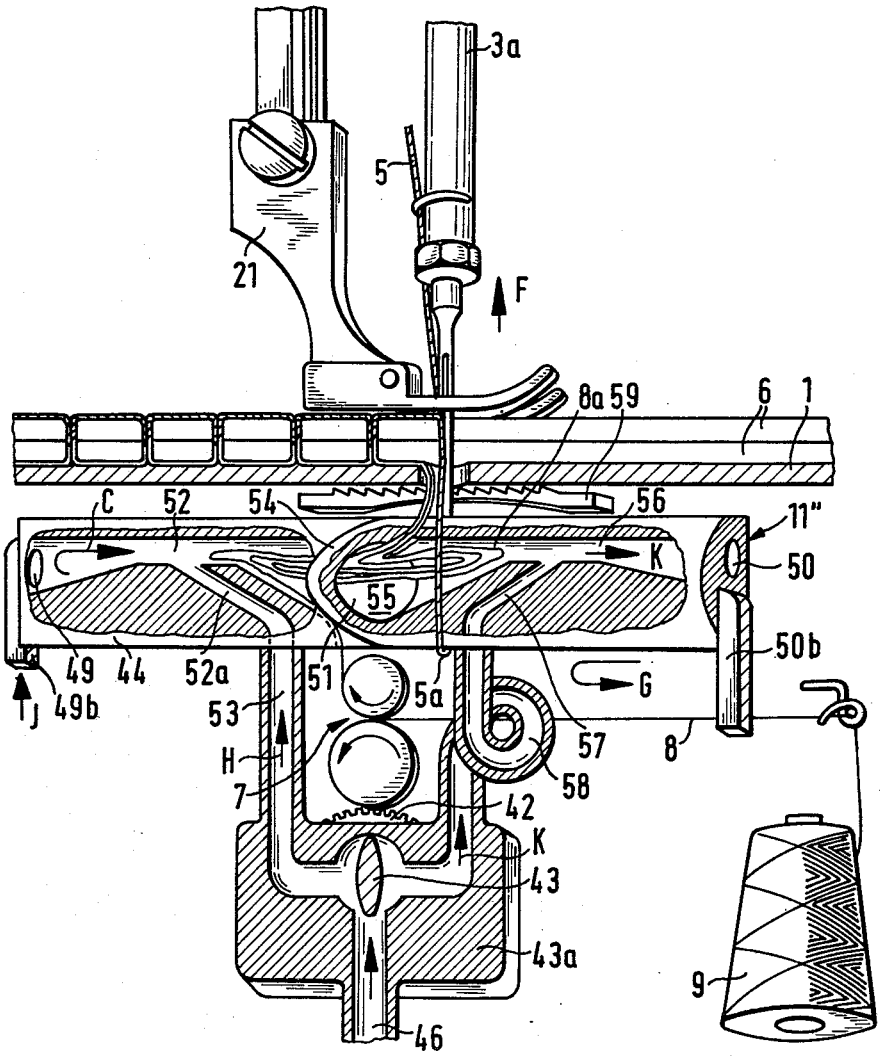
FIG. 13 shows the area after about ½ of the stitch forming time.
Figure 14:
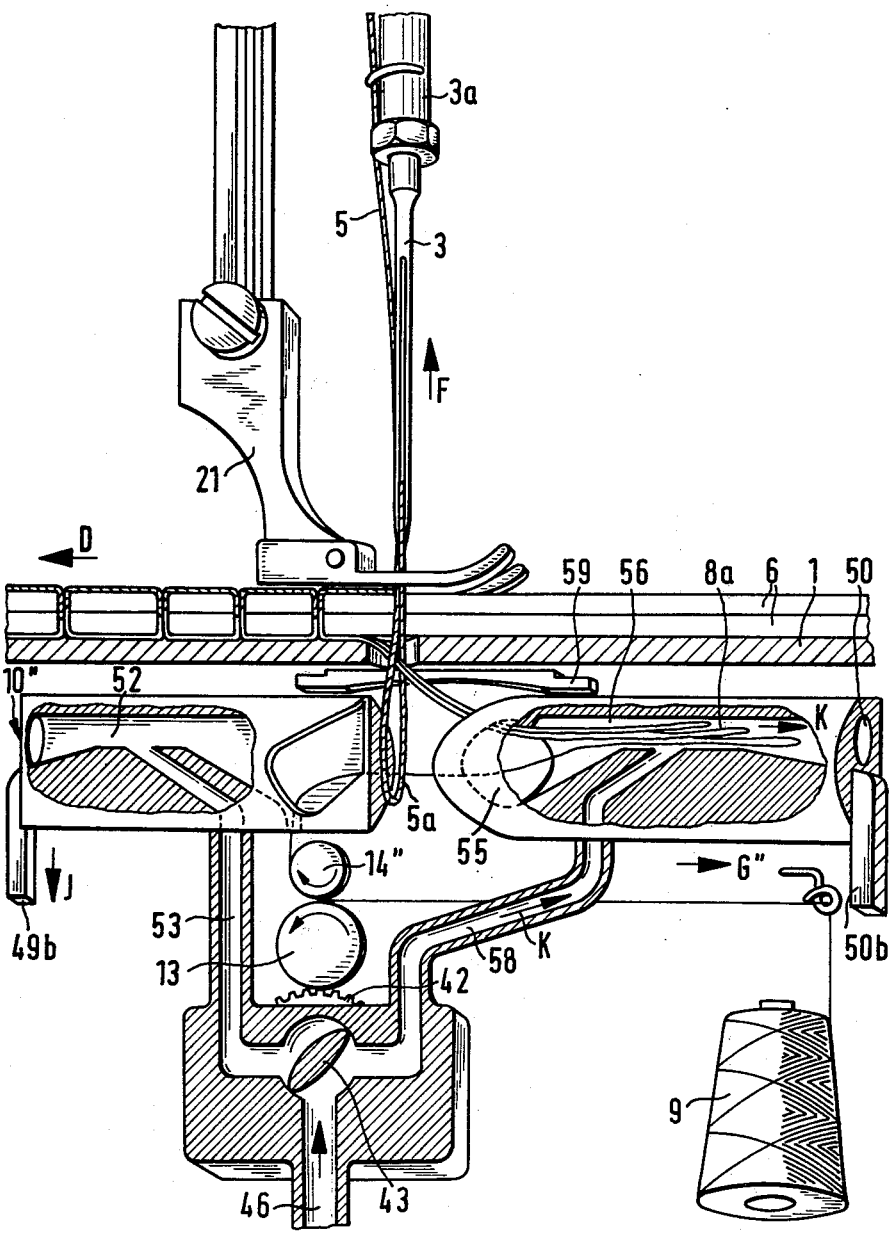
FIG. 14 shows the area after about 4/5 of the stitch-forming time.
Figure 15:
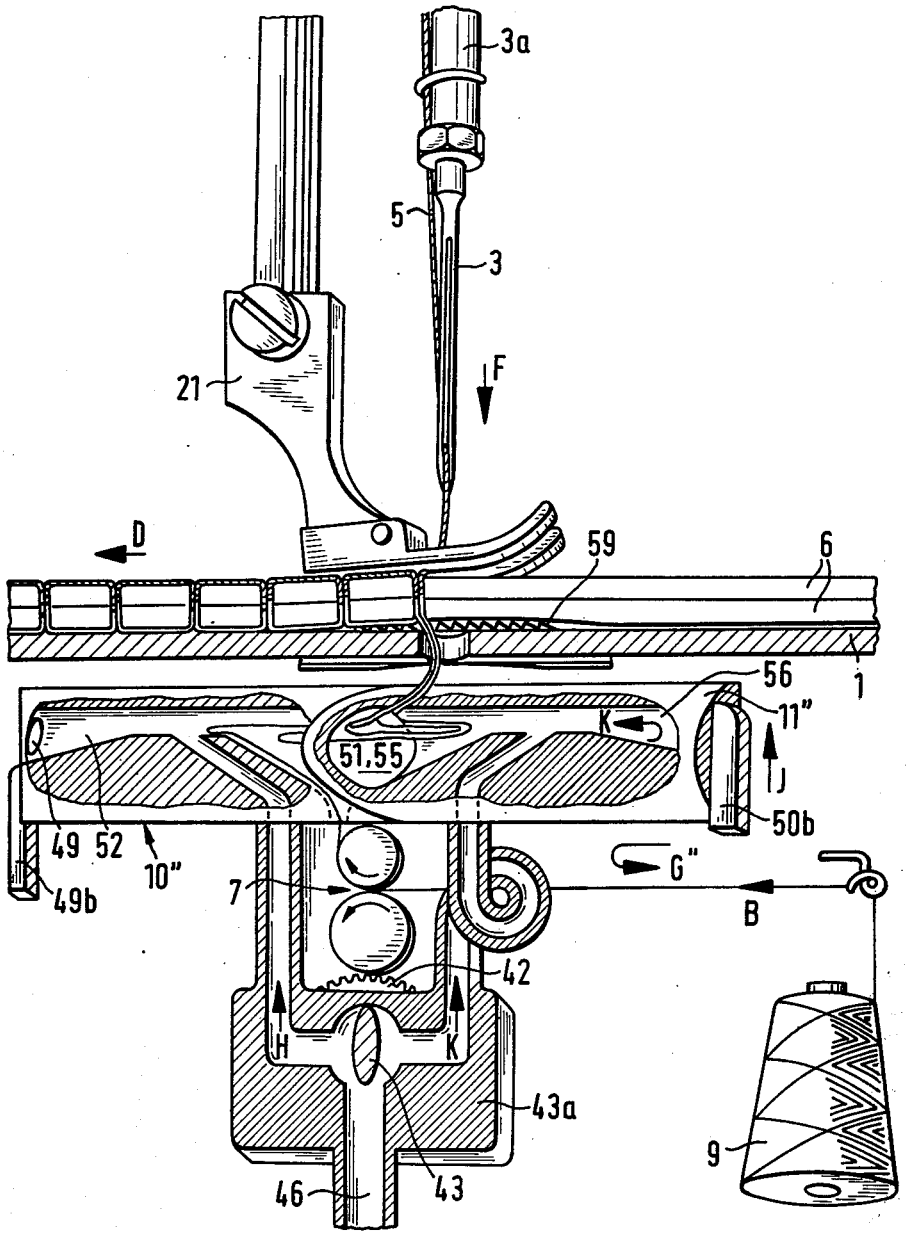
FIGS. 15 and 16 show the finished seam produced according to FIGS. 11 to 15.

FIG. 13 shows the position of the device after about half the stitch-forming time. The needle is already ascending again in the direction of arrow F, it has formed an upper thread loop 5*a* below the sewing material. The fetching device 11" has moved with its rounded point 54*a* through the upper thread loop 5*a* until the passages 51 and 55 are side by side in the feeding end position. At the same time the crank arrangement 41 has moved by means of the spring into the closing position in front of outlet port 49 of the tensioning device and shaft 26 has moved three-way valve 43 over transmission 42 into a central position in which air flows from feeding mechanism 46 both through line 53 and through flexible line 48 (arrows H and K). In air channel 53 of the tensioning device the air direction C is reversed. Instead of a suction effect the air flows in the direction of fetching device 11". In air channel 56 of fetching device 11", there is produced a suction directed toward outlet port 50. The lower thread loops 8*a*' are thus released by the tensioning device, sucked in by the fetching device, and extend through the passages 51 and 55 into air channel 56. The end position of the lower thread loops 8*a*' is shown in FIG. 14, where fetching device 11" has already moved in this phase of stitch-formation in the direction of arrow G" into its rearward position remote from the tensioning device 10" and thus holds the loops tight. Needle 3 is again on its way up in this stage and tightens lower thread loop 5*a*, while three-way valve 43 is already at this time in its third position releasing the air supply to the fetching device and locking the tensioning device. Shutter 49*b* of the tensioning device has already moved down in the direction of the arrow.

Figure 16:
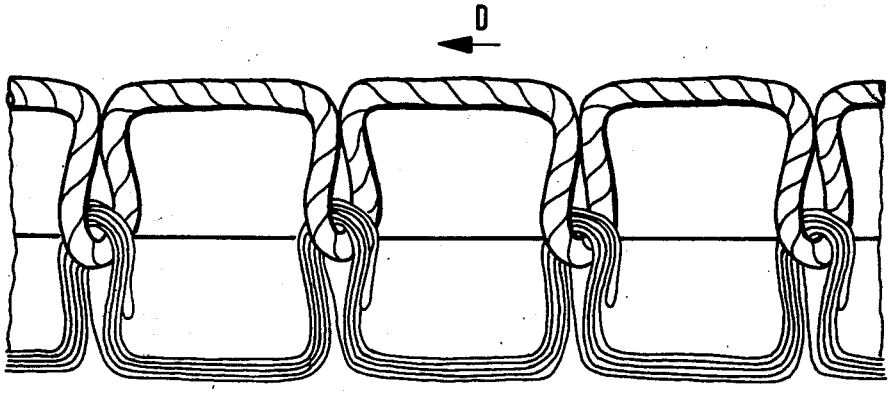

FIG. 14 shows the end of stitch formation and the beginning of the next stitch. The upper loop thread 5*a* is tightened and feed 59 feeds the sewing material in the direction of arrow D by one stitch length. Needle 3 begins with a new descending movement. Fetching device 11" has moved for the second time in a stitch-forming period next to the tensioning device 10", so that the passages 51 and 55 join each other. Three-way valve 43 is in its central position and allows air to flow into lines 53 and 58. Since shutter 50*b* closes outlet port 50 of the fetching device, an air flow is produced in the connected air channels 56 and 52 which is directed from the fetching device to the tensioning device, so that the lower thread loops 8*a*' are brought from the fetching device into the tensioning device and they assume finally the correct position shown in FIG. 12. At the same time, the lower thread material supplied by feeding mechanism 7 is formed to a new loop. Subsequently fetching device 11" moves back for the second time, clearing the seam path for needle 3 between it and the tensioning device. The next stitch can be formed. The resulting seam pattern corresponds to the seam pattern shown in FIG. 16, with each strand section extending over three stitches, that is, four anchoring points. In FIGS. 12 to 15 one lower thread loop has been omitted for clarity's sake, which has so diminished in its free length in the course of several stitch-formations that it can no longer be sucked through passage 51 of the tensioning device, after the return of the fetching device 11" that is, between the position of the device in FIG. 15 and that in FIG. 12, but hangs freely in a short length after the last tightened stitch.

The invention is not limited to the embodiments shown here, in particular the methods according to the invention can also be carried out with other known technical means, which have the same effect. Particularly the tensioning device and/or fetching device can work with mechanical gripping and/or holding means. For the methods according to FIGS. 1 to 9, the space between the feeding mechanism and the tensioning device can be bridged with the thread material to be supplied. In this way the feeding mechanisms or parts thereof and/or the tensioning device are movable toward each other and away from each other, or an additional conveyor element can be provided which can be moved in and out of the thread path. But compared to the devices working with suction or suction and blowing, this is more elaborate. In the methods according to FIGS. 11 to 14, the lower thread material can likewise be cut into individual strand sections.

Depending on the nature of the sewing material, the anticipated streasses, and the appearance of the seam and the nature of the threads used, the lower thread sections or loop can be anchored over a single or more than two stitches.

I claim:

1. Sewing method for forming a double back stitch seam from an upper and lower thread, where the upper thread is moved downwardly by means of a needle through the sewing matter and up again after a loop has been formed on its underside, and the lower thread is conducted through the upper thread loop and anchored on the sewing material by tightening, characterized in that the lower thread is formed continuously during the sewing in several strand sections from thread material, a portion of the lower thread material is moved from a thread supply by a feeding mechanism to a tensioning device for the formation of a strand section, the strand section is engaged by the upper thread loop, and the end region of the strand section anchored on the sewing material by the upper thread loop is gripped by the tensioning device after the upper thread loop has been tightened, together with the next strand section and processed at least during the following stitch for stitch formation, so that the upper thread loops are held by a lower thread consisting of two or more juxtaposed or superposed strand sections.

2. Sewing method according to claim 1, characterized in that the lower thread material is formed, continuously at each stitch, in a loop forming the strand section, and held adjacent its end region by the tensioning device, the two thread zones leading to the closed loop end being jointly anchored on the sewing material.

3. Method according to claim 1, characterized in that each strand section has a minimum length of about three stitches.

4. Method according to claim 1, characterized in that the end regions of all strand sections are released by the tensioning device when they are passed through the upper thread loop and gripped again before the new stitch.

5. Method according to claim 1, characterized in that the strand sections are held each aligned by the tensioning device with the direction of the seams and opposite to the feeding direction of the sewing material, and passed through the upper thread loop substantially perpendicularly to the direction of the seam.

6. Method according to claim 1, characterized in that the strand sections are formed each by the tensioning device substantially in the direction of the seam and codirectionally with the feeding direction of the sewing material, and pulled into the opposite direction when passed through the upper thread loop.

7. Method according to claim 1, characterized in that the end regions of the strand sections are gripped during the passage through the upper thread loop by a flexible fetching device acting substantially opposite the tensioning device, and the strand sections are then tensioned.

8. Method according claim 1, characterized in that the end regions of all strand sections are gripped and held by the tensioning and/or fetching device by suction.

9. Method according to claim 7, characterized in that the end regions of all strand sections are fetched by means of a movement at least partly traversing the upper thread loop from the tensioning device and are fed to it again.

10. Method according to claim 9, characterized in that the end regions of all strand sections are sucked in by the tensioning device for tensioning and blown in the direction of the fetching device for release.

11. Method according to claim 1, characterized in that the lower thread material is cut off at each stitch proximate to the feeding mechanism, after the upper thread loop has been tightened and a new head is gripped by the tensioning device.

12. In a device for forming a double back stitch seam in material to be sewed from an upper thread and a lower thread having a needle for conducting the upper thread through the material, a mechanism for causing needle movement as well as for the formation of an upper thread loop under the material and for tightening the latter, a step feed for the material, and a device movable under the material for moving the lower thread through the upper thread loop, the improvement which comprises a feeding mechanism under the material, withdrawing the lower thread material from a supply and transporting it, at least one tensioning device engaging the thread material supplied for the formation of a strand section, and a reciprocating fetching device for the lower thread material so arranged in the range of the projection of the seam path that the strand section can be gripped by the fetching device and be moved through the upper thread loop.

13. Device according to claim 12, characterized in that the fetching device is designed as a mechanical looper.

14. Device according to claim 12, characterized in that the tensioning device is designed as a suction nozzle with a short/stop switch.

15. Device according to claim 12, characterized in that the fetching device is designed as a suction nozzle with a short/stop switch.

16. Device according to claim 12, characterized in that at least one of the tensioning device and fetching device is a nozzle which can be switched selectively to suction or blowing.

17. Device according to claim 16, characterized in that said one of the tensioning device and fetching device has a joint air feeding mechanism with a three-way valve that can be connected selectively to the tensioning or the fetching device or to both.

18. Device according to claim 14, characterized in that the tensioning device and the fetching device have closeable outlet ports.

19. Device according to claim 14, characterized in that the tensioning device and the fetching device are designed as nozzles sucking in the strand sections by injection.

20. Device according to claim 14, characterized in that the tensioning device and the fetching device have each a housing with a passage for the strand sections which are so arranged that the two passages substantially join each other in the feeding end direction of the fetching device.

21. Device according to claim 20, characterized in that the housing of the tensioning device and the housing of the fetching device have each a substantially semicircular cross-section with a plane surface, with the passages on the plane surfaces, and that the fetching device can be so displaced parallel to the housing of the tensioning device that the straight surfaces at least partly adjoin each other in their feeding end position.

22. Device according to claim 12, characterized in that the fetching device can be moved back and forth twice within a complete needle stroke.

23. Device according to claim 12, characterized in that the feeding mechanism feeding the lower thread material against the feeding direction of the sewing material is arranged in the feeding direction after the needle and directly under or close by the projection of the seam path, and that the flexible tensioning device is arranged in the feeding direction before the needle and directly next to the projection of the ideal seam path extension, and that the fetching device can be moved directly next to the needle substantially perpendicularly to the direction of the seam path.

24. Device according to claim 23, characterized in that the tensioning device and the feeding mechanism are arranged on opposite sides of the projection of the seam path.

25. Device according to claim 23 further comprising a severing device for the lower thread material proximate to the feeding mechanism.

26. Device according to claim 23 characterized in that the fetching device is in the starting position on the same side of the seam path as the feeding mechanism.

27. Device according to claim 23, characterized in that the fetching device is designed as a looper with a hook mouth arranged in a distance from its point, which extends under the mouth opening to the point.

28. Device according to claim 27, characterized in that the hook mouth opening is directed upward.

29. Device according to claim 23 characterized in that a release mechanism for the release of the thread end regions is assigned to the looper at the latest before the start of the new stroke.

30. Device according to claim 23 characterized in that the movement of the fetching device is so long that the following lower thread sections are pulled out automatically.

31. Device according to claim 12 characterized in that the feeding mechanism consists of at least two conveyor rollers rolling off elastically on each other, at least one of which is driven.

32. Device according to claim 31, characterized in that at least one of the conveyor rollers has a circumference corresponding to the length of the lower thread section and carries a cutting element in its circumferential range.

33. Device according to claim 32, characterized in that the feeding mechanism consists of a large conveyor roller corresponding in its circumference to the length of the lower thread section, and at least two pressure rollers bearing in a distance from each other its circumference, and that the last pressure roller in the direction of motion of the thread with the cutting element of the conveyor roller is designed as a severing device.

34. Device according to claim 33, characterized in that a cutting point is arranged as a cutting element on the circumference of the conveyor roller and that the last pressure roller is made of steel.

35. Device according to claim 34, characterized in that the first pressure roller in the direction of motion of the thread is elastically mounted and/or designed to permit passage of the cutting point on the conveyor roller without severing the thread.

* * * * *